US009950513B2

(12) United States Patent
Mizutani et al.

(10) Patent No.: US 9,950,513 B2
(45) Date of Patent: Apr. 24, 2018

(54) LIQUID DISCHARGING DEVICE, CORRECTION CHART GENERATING METHOD, AND RECORDING MEDIUM

(71) Applicants: Tomohiro Mizutani, Tokyo (JP); Takeo Shirato, Kanagawa (JP); Hiroki Takahashi, Kanagawa (JP); Katsuhiro Tobita, Kanagawa (JP); Ryuichi Hayashi, Kanagawa (JP); Yasuyuki Horie, Kanagawa (JP); Takatsugu Maeda, Kanagawa (JP); Hirohito Murate, Kanagawa (JP); Kohtaroh Ikegami, Kanagawa (JP); Kohsuke Inoue, Kanagawa (JP)

(72) Inventors: Tomohiro Mizutani, Tokyo (JP); Takeo Shirato, Kanagawa (JP); Hiroki Takahashi, Kanagawa (JP); Katsuhiro Tobita, Kanagawa (JP); Ryuichi Hayashi, Kanagawa (JP); Yasuyuki Horie, Kanagawa (JP); Takatsugu Maeda, Kanagawa (JP); Hirohito Murate, Kanagawa (JP); Kohtaroh Ikegami, Kanagawa (JP); Kohsuke Inoue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/371,261

(22) Filed: Dec. 7, 2016

(65) Prior Publication Data

US 2017/0165962 A1 Jun. 15, 2017

(30) Foreign Application Priority Data

Dec. 11, 2015 (JP) ..... 2015-242506
Nov. 2, 2016 (JP) ..... 2016-215534

(51) Int. Cl.
*B41J 29/393* (2006.01)
*B41J 2/01* (2006.01)
(Continued)

(52) U.S. Cl.
CPC ..... *B41J 2/01* (2013.01); *B41J 2/04508* (2013.01); *B41J 29/38* (2013.01); *B41J 29/393* (2013.01); *B41J 2029/3935* (2013.01)

(58) Field of Classification Search
CPC ..... B41J 2/01; B41J 29/393; B41J 2/04508; B41J 2/04586; B41J 2029/3935
See application file for complete search history.

(56) References Cited

U.S. PATENT DOCUMENTS

2002/0054302 A1* 5/2002 Nakamura ..... G06K 15/02 358/1.2
2012/0223994 A1* 9/2012 Yuda ..... B41J 2/2132 347/14

(Continued)

FOREIGN PATENT DOCUMENTS

JP 2009-241564 10/2009
JP 2015-214083 12/2015

*Primary Examiner* — Yaovi M Ameh
(74) *Attorney, Agent, or Firm* — Harness, Dickey & Pierce, P.L.C.

(57) ABSTRACT

A controller for a liquid discharging device generates a correction chart including a reference pattern and a correction part, using a liquid discharged from a liquid discharge head, the liquid discharge head having a plurality of nozzles that are arranged to form a nozzle array. The controller drives a predetermined number of the plurality of nozzles to form the reference pattern on the recording sheet along a direction of the nozzle array, the predetermined number being a number equal to or less than a total number of the plurality of nozzles of the nozzle array, and drives a number of the plurality of nozzles that is different than the predetermined number of nozzles driven in forming the reference (Continued)

pattern, to form the correction pattern on the recording sheet along the direction of the nozzle array.

10 Claims, 13 Drawing Sheets

(51) Int. Cl.
*B41J 2/045* (2006.01)
*B41J 29/38* (2006.01)

(56) References Cited

U.S. PATENT DOCUMENTS

2014/0152737 A1* 6/2014 Okada ..... B41J 2/12
347/19
2016/0236466 A1 8/2016 Takahashi et al.

* cited by examiner

LIQUID DISCHARGING DEVICE, CORRECTION CHART GENERATING METHOD, AND RECORDING MEDIUM

CROSS-REFERENCE TO RELATED APPLICATIONS

This patent application is based on and claims priority pursuant to 35 U.S.C. § 119(a) to Japanese Patent Application Nos. 2015-242506, filed on Dec. 11, 2015, and 2016-215534, filed on Nov. 2, 2016, in the Japan Patent Office, the entire disclosure of which is hereby incorporated by reference herein.

BACKGROUND

Technical Field

The present invention relates to a liquid discharging device, a correction chart generating method, and a non-transitory recording medium.

Description of the Related Art

Liquid discharging devices such as inkjet recording devices and the like discharge droplets through nozzles by increasing a pressure in a liquid chamber in which a liquid such as ink is stored. The liquid discharging device is provided with a liquid discharge head having a plurality of nozzles.

The plurality of nozzles of the liquid discharge head is arranged adjacent to each other. When a time for discharging the liquid from one nozzle, and a time for discharging the liquid from the nozzle adjacent to that nozzle becomes the same, a discharge amount and a discharge speed of that nozzle changes. That is, characteristics of operation for driving to discharge the liquid for one nozzle changes due to operation of discharging the other nozzle near that nozzle. This phenomenon is known as "crosstalk".

If the crosstalk occurs, density unevenness and streak may be caused by the ink droplets on the recording medium, resulting in lowering image quality.

SUMMARY

Example embodiments of the present invention include a liquid discharging device, which includes: a liquid discharge head having a plurality of nozzles that are arranged to form a nozzle array; and a controller to drive the liquid discharge head to discharge a liquid to form an image on a recording sheet. When forming a correction chart including a reference pattern and a correction pattern, the controller drives a predetermined number of the plurality of nozzles to form the reference pattern on the recording sheet along a direction of the nozzle array, the predetermined number being a number equal to or less than a total number of the plurality of nozzles of the nozzle array, and drives a number of the plurality of nozzles that is different than the predetermined number of nozzles driven in forming the reference pattern, to form the correction pattern on the recording sheet along the direction of the nozzle array Example embodiments of the present invention include a method of generating a correction chart including a reference pattern and a correction part, using a liquid discharged from a liquid discharge head, the liquid discharge head having a plurality of nozzles that are arranged to form a nozzle array. The method includes: driving a predetermined number of the plurality of nozzles to form the reference pattern on the recording sheet along a direction of the nozzle array, the predetermined number being a number equal to or less than a total number of the plurality of nozzles of the nozzle array; and driving a number of the plurality of nozzles that is different than the predetermined number of nozzles driven in forming the reference pattern, to form the correction pattern on the recording sheet along the direction of the nozzle array.

Example embodiments of the present invention include a non-transitory recording medium storing a control program for controlling the liquid discharge head to perform the above-described operation.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
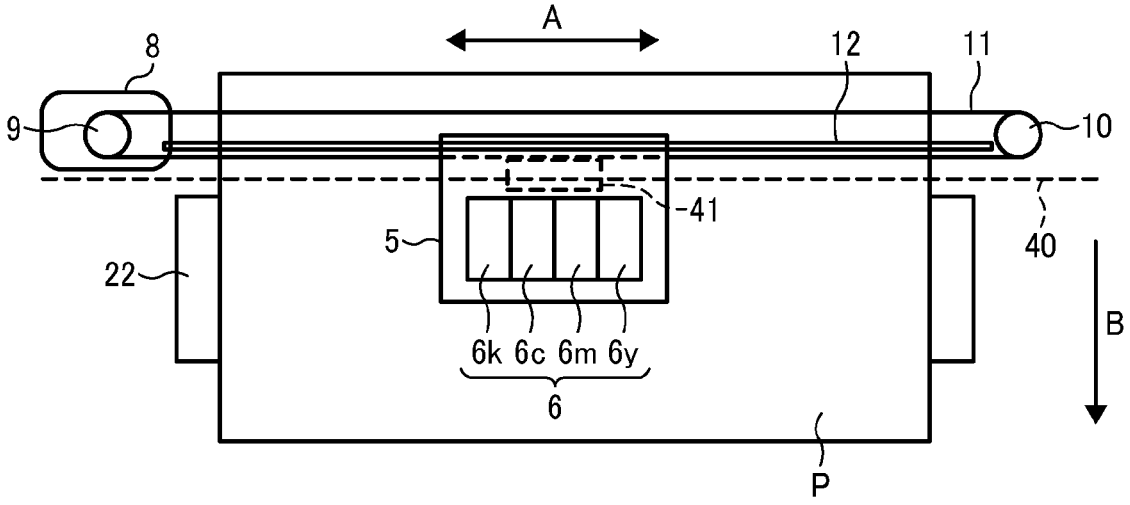
FIG. 1 is a plan view illustrating a configuration of a serial head according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to the drawings, a liquid discharge head to be applied to the liquid discharging device is described according to embodiments of the present invention.

FIG. 1 illustrates the liquid discharge head, when a serial head is applied. The serial head illustrated in FIG. 1, which is applied to color printing, includes a carriage 5 and a liquid discharge head 6 disposed on the carriage 5. The liquid discharge head 6 includes a plurality of liquid discharge heads 6*y*, 6*m*, 6*c*, and 6*k*, arranged side by side, which respectively discharge liquids of yellow, magenta, cyan, and black. Note that, in the following disclosure, the liquid discharge heads 6*y*, 6*m*, 6*c*, and 6*k* of the respective colors on the carriage 5 are collectively referred to as the "liquid discharge head 6". The carriage 5 is connected to a timing belt 11, which is an endless belt that stretches around a gear 9 and a pressure roller 10. As the gear 9 is rotated with a main-scanning motor 8, the carriage 5 is moved along with rotation of the timing belt 11. More specifically, the carriage 5 moves in a reciprocating manner in a direction of the arrow A in FIG. 1 along a guide rod 12. The arrow A corresponds to a main-scanning direction. In this disclosure, operation of moving the carriage 5 in the main-scanning direction along the guide rod 12 is referred to as scan operation.

The position of the carriage 5 in the main-scanning direction is detected by reading a linear scale 40 provided along the main-scanning direction of the carriage 5 with a linear encoder 41 provided in the carriage 5.

With activation of the liquid discharging device, the main scanning motor 8 is driven to cause the carriage 5 to perform the above-described scan operation. At the same time, a sheet recording medium P such as a recording sheet is conveyed by a conveyance roller driven by a sheet feeding motor, and is conveyed from a sheet feeding section to a platen 22 in a direction of the arrow B in FIG. 1. As described below, the scan operation may be repeated a plurality of times in generating a correction chart.

The arrow B corresponds to a sub-scanning direction perpendicular to the main-scanning direction. A rotating position of the conveyance roller is detected from an output signal of a rotary encoder provided in the conveyance roller. As described below, a control device is provided, which controls discharge of the liquid through nozzles provided in the liquid discharge head 6, to print an image on the recording medium P.

Figure 2:
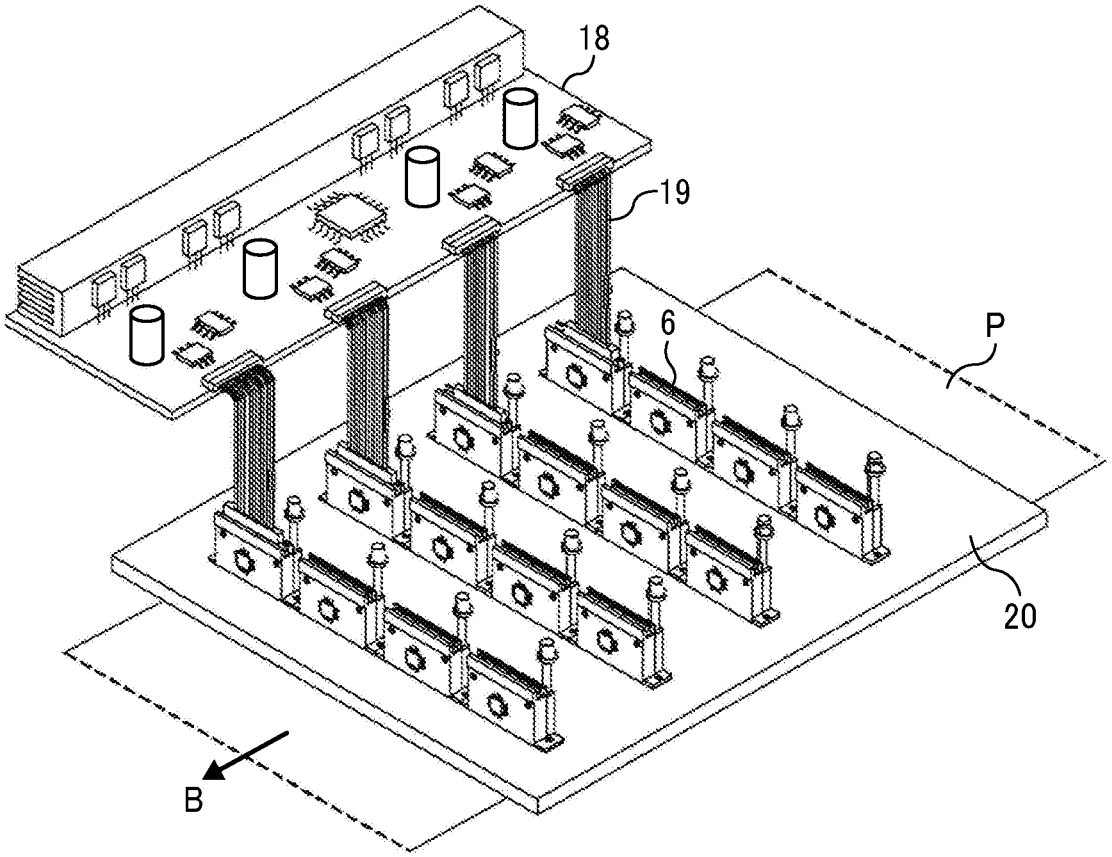
FIG. 2 is a plan view illustrating a configuration of a line head according to an embodiment of the present invention.

Next, a configuration of a line head applied to the liquid discharging device, in alternative to the recording head, will be described referring to FIG. 2. The line head illustrated in FIG. 2 mainly includes an adjust plate 20, the liquid discharge heads 6 arranged on the adjust plate 20, a drive control board 18 that controls driving of the liquid discharge heads 6, and flat cables 19 that connect the liquid discharge heads 6 and the drive control board 18. The line head of FIG. 2 includes a plurality of liquid discharge heads 6*y*, 6*m*, 6*c*, and 6*k*, arranged side by side over an entire width of the recording medium P, which respectively discharge liquids of yellow, magenta, cyan, and black.

The adjust plate 20 arranges and secures the plurality of liquid discharge heads 6 with high accuracy. The drive control board 18 is a rigid board mounted with a circuit for generating a drive waveform signal for driving piezoelectric elements for liquid discharge that is provided in the liquid discharge heads 6, and a circuit for generating an image data signal. The flat cables 19 are used to electrically connect the drive control board 18 and the liquid discharge heads 6.

The piezoelectric elements in the liquid discharge head 6 is driven according to the drive waveform signal and the image data signal transmitted from the drive control board 18. The driving of the piezoelectric elements generates a pressure in the liquid chamber storing the liquid (ink), which causes the liquid to be discharged on the recording medium P.

The liquid discharge head 6 includes the nozzles for discharging the liquid, which together form a nozzle surface. The nozzle surface is kept at a location with a predetermined space away from the platen 22 (FIG. 1) supporting the recording medium P. The nozzle surface of the liquid discharge head 6 is driven, such that the ink of the respective colors are discharged according to a conveyance speed of the recording medium P, so that a color image is formed on the recording medium P.

Figure 3:
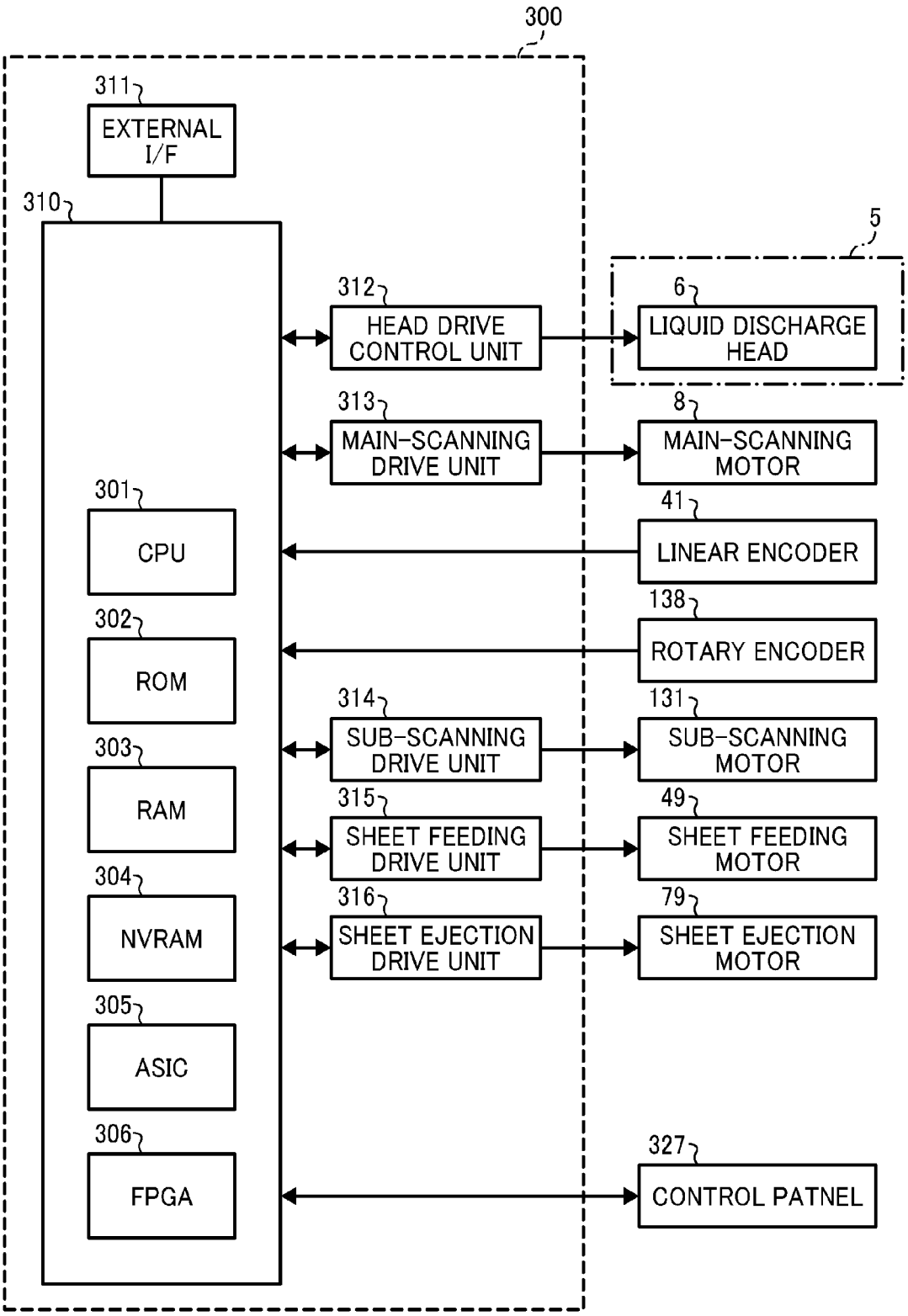
FIG. 3 is a schematic block diagram illustrating a configuration of a control device provided in a liquid discharging device according to an embodiment.

Referring to FIG. 3, a configuration of a head controller 300 that controls operation of the liquid discharge head 6 is described according to an embodiment of the present invention.

As illustrated in FIG. 3, the controller 300 includes a main control unit 310, an external interface (I/F) 311, a head drive control unit 312, a main-scanning drive unit 313, a sub-scanning drive unit 314, a sheet feeding drive unit 315, and a sheet ejection drive unit 316.

The main control unit 310 controls entire operation of the liquid discharging device, and controls formation of a correction chart and correction of amplification of the drive voltage to be used for driving the liquid discharge head 6. The external I/F 311 transmits or receives various data or signals between the main control unit 310 and a host device such as a personal computer.

The head drive control unit 312 may be implemented by an application specific integrated circuit (ASIC) for head data generation arrangement conversion, which is to be used for driving the liquid discharge head 6. The main-scanning drive unit 313 controls driving of the main-scanning motor 8. The sub-scanning drive unit 314 controls driving of a sub-scanning motor 131. The sheet feeding drive unit 315 drives a sheet feeding motor 49. The sheet ejection drive unit 316 drives a sheet ejection motor 79 that drives rollers provided in a sheet ejection section of the ink discharging device.

Although not illustrated in FIG. 3, the controller 300 further includes a recovery system drive unit for driving a maintenance and recovery motor in the liquid discharging device, a solenoid drive unit that drives various solenoids, and a clutch drive unit that drives an electromagnetic clutches and the like.

The main control unit 310 includes a central processing unit (CPU) 301, a read-only memory (ROM) 302, a random access memory (RAM) 303, a non-volatile random access memory (NVRAM) 304, an application specific integrated circuit (ASIC) 305, and a field programmable gate array (FPGA) 306.

The CPU 301 performs various calculations to be used by the controller 300 in controlling the liquid discharge head 6, according to the control program or the fixed data stored in the ROM 302. The ROM 302 is a memory that stores various control programs to be executed by the CPU 301 and other fixed data (including an inspection chart). The RAM 303 is a memory that functions as a work area for the CPU 301 in executing the control program, and that temporarily stores data of a printed image formed with the control program.

The NVRAM 304 is a non-volatile memory that keeps storing data even after a power of the liquid discharging device is turned off. The ASIC 305 is a customized IC dedicated to image processing, such as a circuit for processing various image signals related to image data or rearranging image data. The FPGA 306 is an image signal processor that processes input/output signals for controlling the entire liquid discharging device.

The main control unit 310 is input with an output signal of the linear encoder 41 that detects the position of the carriage 5, and an output signal of the rotary encoder 138 that detects the rotating position of the conveyance roller that conveys the recording medium P in the sub-scanning direction. The main control unit 310 moves the carriage 5 in a reciprocating manner in the main-scanning direction by driving the main-scanning motor 8 based on the output signal of the linear encoder 41. Further, the main control unit 310 moves the recording medium P through the conveyance roller by driving the sub-scanning motor 131 based on the output signal of the rotary encoder 138.

The main control unit 310 is further connected to a control panel 327, which functions as an operation and display unit. The control panel 327 includes various keys such as numeric keys and a print start key provided in a main body of the liquid discharging device, and a display that displays an operating state of the liquid discharging device. The main control unit 310 takes in a key input output from the control panel 327, and outputs display information to the control panel 327.

Further, in response to a correction request received from the control panel 327, the main control unit 310 drives the liquid discharge head 6 through the head drive control unit 312 to perform processing of forming a correction chart on the recording medium P. When the correction request is received from the control panel 327 after the correction chart is formed, the main control unit 310 performs control to correct an amplification of the driving voltage so that printing shift due to crosstalk is canceled. The input operation to the control panel 327 is performed by a user.

The main control unit 310 is input with detection signals of various sensors provided in respective sections of the liquid discharging device. Accordingly, the controller 300 controls driving of the entire liquid discharging device.

Figure 4:
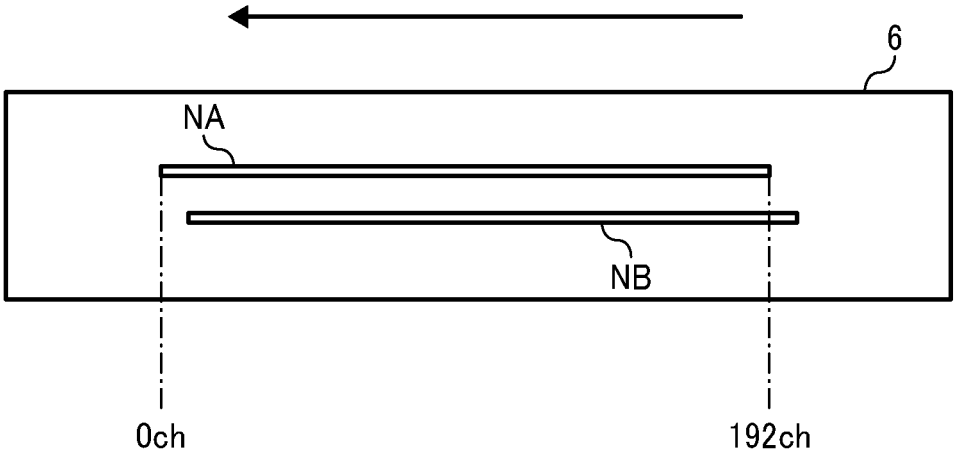
FIG. 4 is a diagram schematically illustrating nozzle arrangement of a liquid discharge head provided in the liquid discharging device according to an embodiment.

FIG. 4 illustrates an example of the liquid discharge head 6 according to an embodiment. As illustrated in FIG. 4, the liquid discharge head 6 includes a nozzle array NA and a nozzle array NB. Each of the nozzle array NA and the nozzle array NB includes nozzles 1 to 192 ch (channels). Each nozzle, which is individually driven, functions as a discharge port for discharging the liquid. The nozzle array NA and the nozzle array NB are arranged so that they are slightly shifted from each other in the conveyance direction of the recording medium P.

The arrow in FIG. 4 indicates a conveyance direction of the recording medium P, as described above referring to FIG. 1 for the case of serial head. The liquid discharge head 6 is disposed, such that the nozzle arrays are arranged in parallel with respect to the conveyance direction of the recording medium P. In case of the line head, the liquid discharge head 6 is disposed, such that the nozzle arrays are arranged to be perpendicular to the conveyance direction of the recording medium P.

Figure 5:
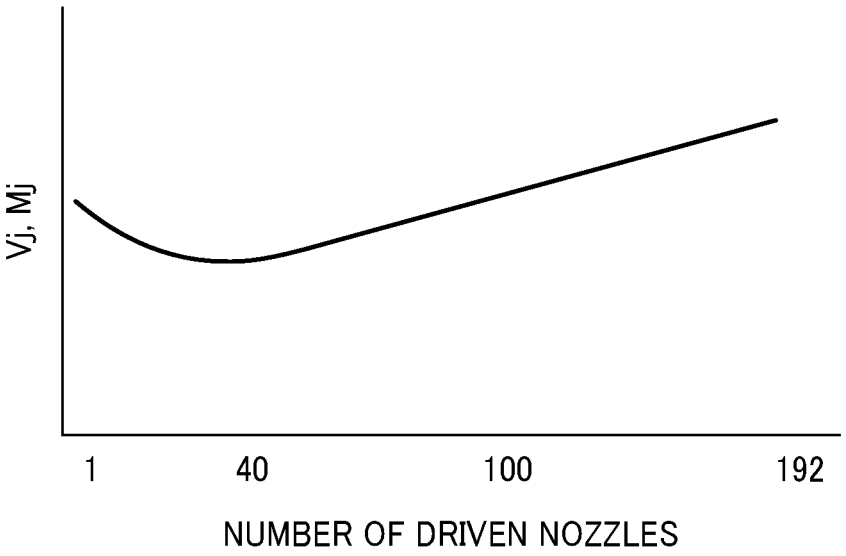
FIG. 5 is a graph illustrating a conventionally known relationship between the number of drive nozzles, and a liquid discharge speed and a liquid discharge amount.

Referring now to FIG. 5, a relationship among the number of driven nozzles, of all of the nozzles provided in the liquid discharge head 6, a liquid discharge amount Mj of the liquid discharged through the driven nozzles, and a liquid discharge speed of the liquid discharged through the driven nozzles, is described. The graph of FIG. 5 shows the number of drive nozzles in the horizontal axis, and a liquid (ink) discharge speed Vj and a liquid (ink) discharge amount Mj in the vertical axis.

As illustrated in FIG. 5, the liquid discharge speed (Vj) and the liquid discharge amount (Mj) increase almost proportionally according to the increase in the number of driven nozzles. The number of driven nozzles changes ways of occurrence of overshoot and undershoot in the drive waveform. That is, the overshoot and undershoot of the drive waveform influence voltage amplitude of the drive waveform. As the voltage amplitude of the drive waveform increases, the liquid discharge speed (Vj) and the liquid discharge amount (Mj) both increase. Depending on the number of driven nozzles, the crosstalk may occur, which may influence the liquid discharge speed (Vj) and the liquid discharge amount (Mj).

As described above, the crosstalk is changed according to the number of driven nozzles, which then vary the ink discharge speed (Vj) and the ink discharge amount (Mj), causing density unevenness and printing shift. That is, the change in number of driven nozzles may cause deterioration in image, thus decrease in image equality.

However, the density unevenness of an image may occur due to causes other than the crosstalk. Therefore, to accurately correct the crosstalk, it is necessary to reliably isolate the density unevenness of an image due to the crosstalk and the density unevenness of an image due to other causes.

In the liquid discharging device with a serial head, the discharge unevenness of the liquid, which may result in density unevenness, arises from periodical vibration associated with conveyance of the serial head in the main-scanning direction. Therefore, it would be difficult to isolate such discharge uneveness caused by periodical vibration from the above-described discharge uneveness due to the crosstalk. Even when characteristics in liquid discharge is obtained using the simple correction chart, it would be difficult to suppress the crosstalk with high accuracy, in the liquid discharging device with a serial head.

Further, in the liquid discharging device with a line head, the discharge unevenness of the liquid, which may result in density unevenness or streak, arises from vibration associated with conveyance of a recording medium that receives the droplets discharged through the nozzles. Therefore, it would be difficult to isolate such discharge uneveness caused by the periodical vibration from the above-described discharge uneveness due to the crosstalk. Even when characteristics in liquid discharge is obtained using the simple correction chart, it would be difficult to suppress the crosstalk with high accuracy, in the liquid discharging device with a line head.

In view of the above, the liquid discharging device in this disclosure is able to create a correction chart, which is capable of isolating the density unevenness of an image due to the crosstalk from the density unevenness of an image due to the other causes. Further, the liquid discharging characteristics of the liquid discharging device, which is obtained using the correction chart, may be corrected with high accuracy. In the following, the correction chart capable of isolating the cause for density uneveness, or decrease in image quality, is described. In this disclosure, the case when the liquid discharge head 6 is a serial head (FIG. 1), and the case when the liquid discharge head 6 is a line head (FIG. 2) are both described.

Figure 6:
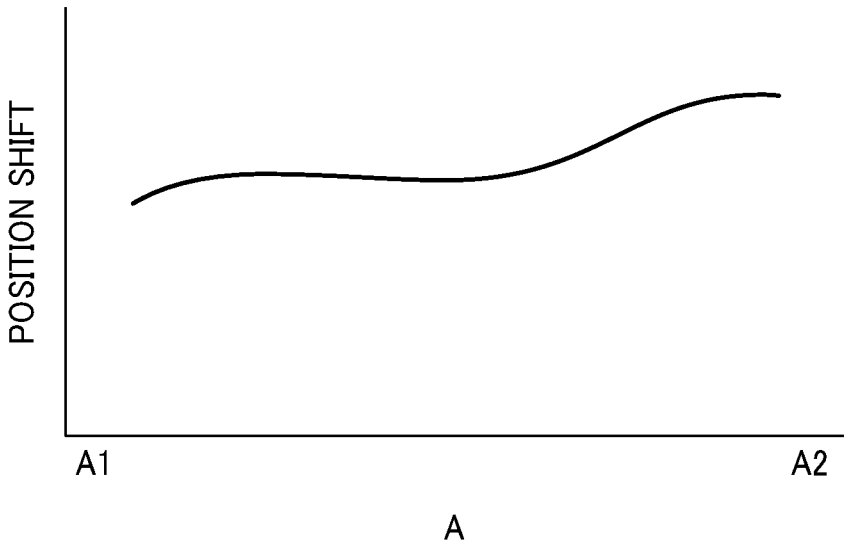
FIG. 6 is a graph illustrating a conventionally known relationship between a moving distance of a serial head in a main-scanning direction, and shift of a printing position by a guide rod.

The causes for the density unevenness of an image in the liquid discharging device with a serial head, other than the crosstalk, are mainly caused by a position shift of the liquid discharge head 6 when the carriage 5 is scanned in the main-scanning direction along the guide rod 12. The position shift of the liquid discharge head 6 arises from forming accuracy and attaching accuracy of the guide rod 12. As illustrated in FIG. 6, the degree of position shift of the liquid discharge head 6, due to the forming or attaching accuracy of the guide rod 12, gently changes with respect to a scanning distance of the carriage 5 in the main-scanning direction. FIG. 6 shows the degree of position shift in the vertical axis, and the position in the main-scanning direction A in the horizontal axis. A1 and A2 respectively represent a leading end and a tailing end of the recording medium. The leading end of the recording medium P corresponds to a reference point in the main-scanning direction where scan operation by the liquid discharge head 6 starts. In the case of serial head, if the correction chart is created in a short moving distance of the liquid discharge head 6 in the main-scanning direction, the resultant correction chart would reflect the density unevenness of an image due to the crosstalk. That is, with such correction chart, the density unevenness of an image due to the crosstalk and the density unevenness of an image due to other causes can be reliably isolated.

Figure 10A:
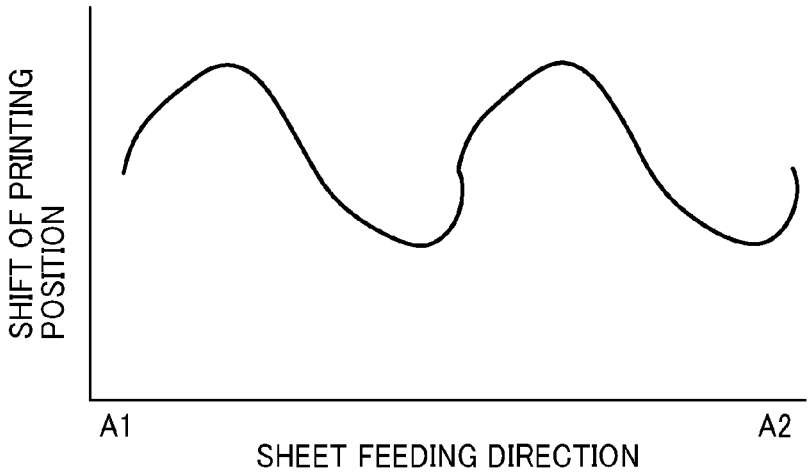
FIG. 10A is a graph illustrating a conventionally known relationship between a sheet feeding direction and shift of a printing position by an eccentric roller, of a liquid discharging device including a line head.
Figure 10B:
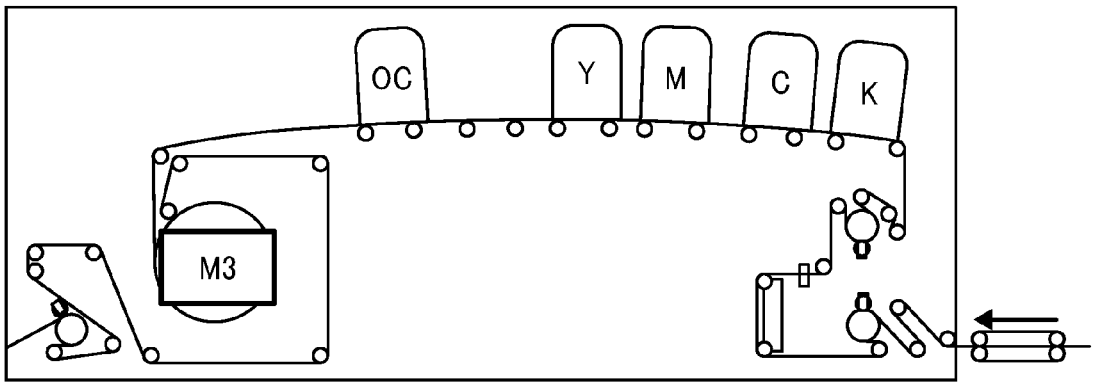
FIG. 10B is a cross-sectional view illustrating a configuration of the liquid discharging device provided with conveyance rollers.

In the case of the liquid discharging device including the line head, the causes for the density unevenness of an image other than the crosstalk are mainly caused by shift in a transfer speed of the recording medium P. This shift of the transfer speed of the recording medium P arises from eccentricity of rollers that convey the recording medium P. In the case of the liquid discharging device of FIG. 10B with a line head, the biggest-size roller M3 that conveys the recording medium P has an eccentricity of about 560 mm. The shift in the transfer speed of the recording medium P arising from eccentricity of rollers that convey the recording medium P, gently changes in a sheet feeding direction of the recording medium P, as illustrated in FIG. 10A. FIG. 10A shows the shift in printing position that reflects the shift in transfer speed due to eccentricity of rollers in the vertical axis, and the sheet feeding direction in the horizontal axis. A1 and A2 respectively represent a leading end and a tailing end of the recording medium. In the case of line head, if the correction chart is created in a short distance of the recording medium P in the sheet conveyance direction, the resultant correction chart would reflect the density unevenness of an image due to the crosstalk. That is, with such correction chart, the density unevenness of an image due to the crosstalk and the density unevenness of an image due to other causes can be reliably isolated.

As described above, in the liquid discharging device, the correction chart that reflects the density uneveness of an image due to the crosstalk is generated at a short distance, in terms of a moving distance of the liquid discharge head 6 in the main-scanning direction, or in terms of a conveyance distance of the recording medium P. That is, with such correction chart, the density unevenness of an image due to the crosstalk and the density unevenness of an image due to other causes can be reliably isolated.

Figure 7A:
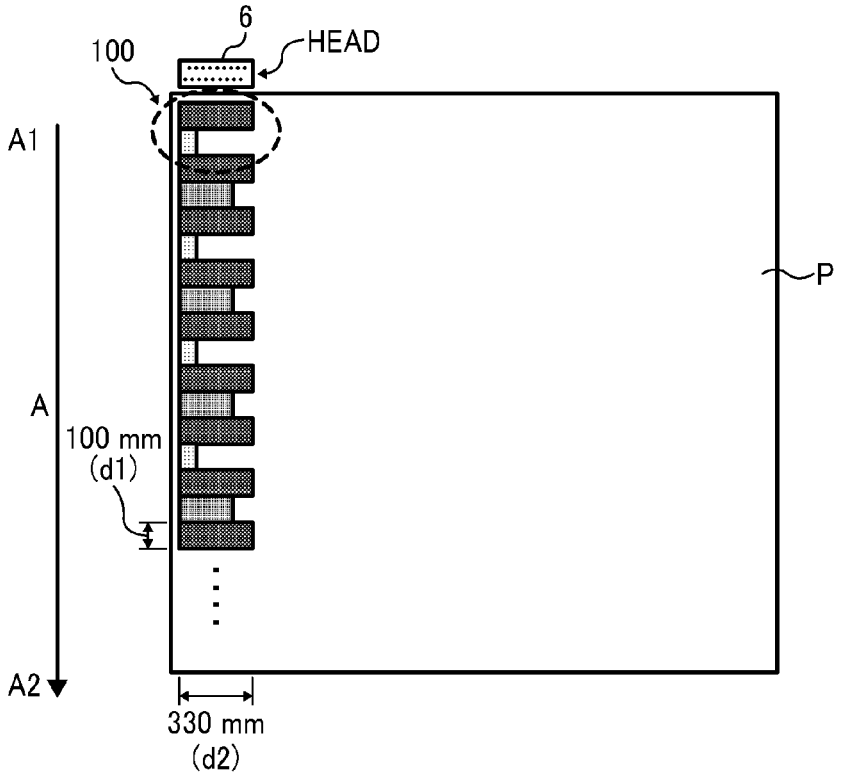
FIGS. 7A and 7B are diagrams illustrating an example of a correction chart, which is formed using a serial head according to an embodiment.
Figure 7B:
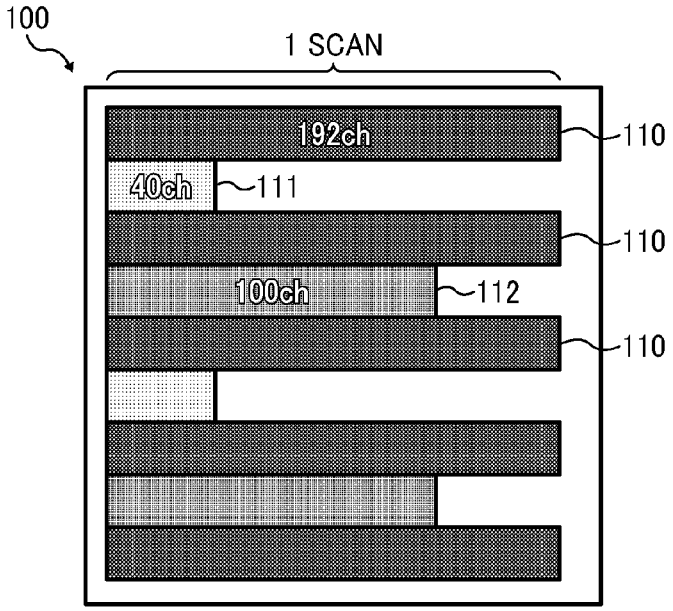

Next, the correction chart 100 generated for the above-described liquid discharging device is described. The correction chart 100 described below referring to FIGS. 7A and 7B is a correction chart for the liquid discharging device with a serial head. The correction chart 100 includes a reference pattern 110, a first correction pattern 111, and a second correction pattern 112, which are formed on the recording medium P. FIG. 7A illustrates the correction chart 100, which is formed on the recording medium P. FIG. 7B illustrates an enlarged view of a section at a leading end of the recording medium P with a part of the correction chart 100, which is indicated with a circle in FIG. 7A.

As illustrated in FIG. 7A, a plurality of patterns are formed side by side, from the leading end of the recording medium P in the main-scanning direction (corresponding to the reference point where the scan operation by the liquid discharge head 6 starts), to the tailing end of the recording medium P in the main-scanning direction. The adjacent patterns are formed without a gap therebetween. Each pattern has a size of about 100 mm (indicated by "d1" in FIG. 7A), in the main-scanning direction. The size of each pattern in the sub-scanning direction changes depending on the number of driven nozzles for forming the patterns. In this example, the reference pattern 110 has a size of about 330 mm (indicated by "d2" in FIG. 7A).

As illustrated in FIGS. 7A and 7B, in the correction chart 100, the first correction pattern 111 and the second correction pattern 112 are alternatively formed between the adjacent reference patterns 110.

The reference pattern 110 is formed by driving the nozzles of the 192 ch (see FIG. 4) provided in the liquid discharge head 6.

The first correction pattern 111 and the second correction pattern 112 are respectively formed by the number of nozzles different than that of the reference pattern 110. For example, the first correction pattern 111 is formed by driving the nozzles of 40 ch selected from among the nozzles of 192 ch. The second correction pattern 112 is formed by driving the nozzles of 100 ch selected from among the nozzles of 192 ch.

That is, the correction chart 100 includes the reference pattern 110 that is formed by simultaneously driving all of the nozzles in the nozzle array, and the first correction pattern 111 and the second correction pattern 112 that are formed by driving a different number of nozzles than that of the reference pattern 110. As illustrated in FIG. 7A, formation of the reference pattern 110 and formation of the correction patterns (first correction pattern 111 and second correction pattern 112) are repeated in a predetermined order. That is, the correction chart 100 is formed by repeating formation of a plurality of patterns while changing a number of driven nozzles to be driven at a time, in a predetermined order. The drive waveform to be used in forming these patterns is adjusted by applying different drive waveform amplification.

As illustrated in FIGS. 7A and 7B, no margin is made between the patterns formed on the recording medium P. This makes it easy to compare between the reference pattern 110 and the correction pattern 111 or 112. Further, an end portion of the reference pattern 110 and an end portion of the correction pattern 111 or 112 are brought close to a left end or a right end of a print width of the recording medium P. In doing so, the drive waveform can be corrected with an image closer to an image to be formed with an actual device.

The width of the reference pattern 110, the width of the correction pattern 111 or 112, the number of driven nozzles in forming each pattern, and the amplification of the drive waveform to be applied in forming each pattern, are input by the user by operating the control panel 327.

Note that, in the above-described embodiment, the reference pattern 110 is formed by driving the nozzles of 192 ch. However, since the density of the reference pattern 110 is different according to the density desired by the user, the reference pattern 110 may be formed with a smaller number of driven nozzles than 192 ch. For example, the density may be changed according to a user input, through changing a number of driven nozzles in forming each pattern.

In actual printing, the influence of the crosstalk becomes significant in a joint portion of the liquid discharge head 6. Therefore, the first correction pattern 111 may be formed with an arbitrary number of driven nozzles (1 to 40 ch) equal to or smaller than 40 ch, and the second correction pattern 112 may be formed with an arbitrary number of driven nozzles (1 to 100 ch) equal to or smaller than 100 ch. Further, types of the correction patterns are not limited two, and can be an arbitrary number.

In the case of serial head, the correction chart is desirably formed in a main-scanning direction position (see FIG. 6), where the position shift of the liquid discharge head 6 is small, in order to easily isolate the density unevenness of an image due to the crosstalk and the density unevenness of an image due to other causes. In the case of line head, the correction chart is preferably formed in a sheet conveyance direction position (See FIG. 10A), where the shift in transfer speed of the recording medium P is small.

Figure 8:
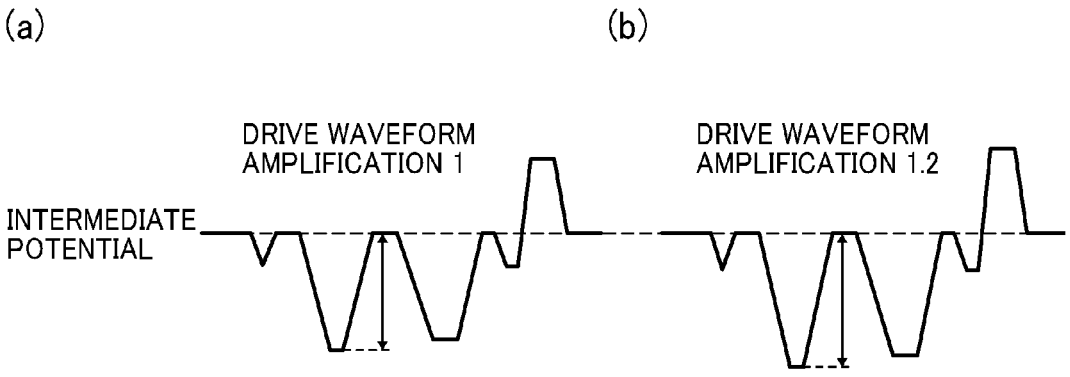
FIG. 8 is a diagram illustrating a concept of amplification correction of a drive waveform applied to a liquid discharge head according to an embodiment.

Next, operation of correcting the crosstalk is described. The correction of the crosstalk is performed by changing the amplification of the drive waveform applied to the liquid discharge head 6. As illustrated in FIG. 8, the amplification correction of the drive waveform is performed such that an intermediate potential of the drive waveform is maintained, and the section other than the intermediate potential is changed by multiplying with a predetermined number as a correction amount. For example, as illustrated in FIG. 8(*a*), when the drive waveform amplification is "1", a correction value (drive waveform amplification) of 0% is used in correcting the drive waveform. As illustrated in FIG. 8(*b*), when the drive waveform amplification is "1.2", a correction value of 20% is used in correcting the drive waveform. When the drive waveform amplification is "1.1", a correction value of 10% is used.

In generating the correction chart, an original drive waveform table is read from the ROM 302 (see FIG. 3), to multiply a desired amplification to values other than the intermediate potential. Correction of the amplification of the drive waveform suppresses influenced by the crosstalk.

Figure 9:
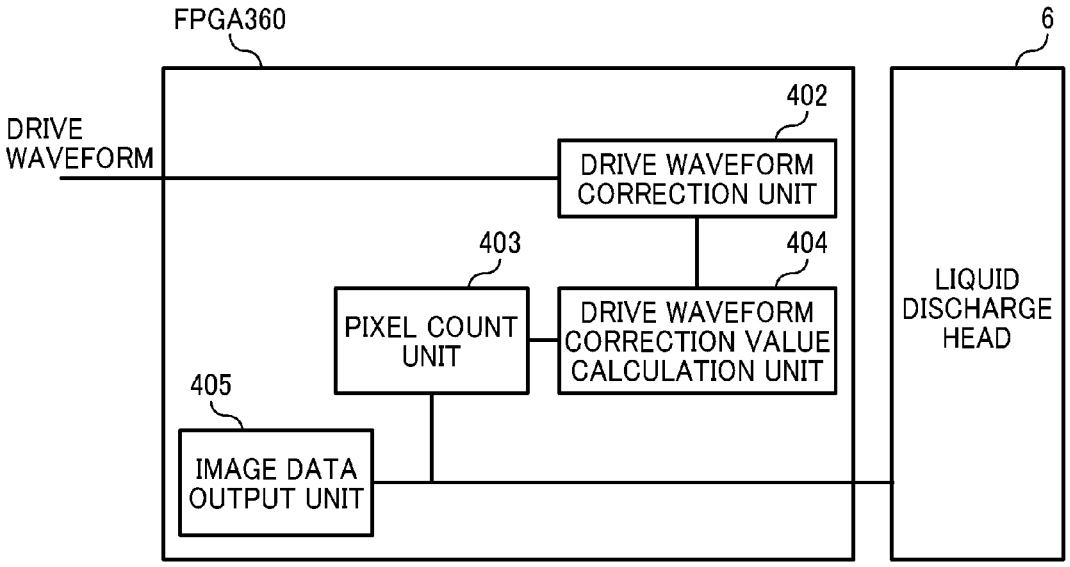
FIG. 9 is a schematic block diagram illustrating a functional configuration of a correction control unit according to an embodiment.

Next, a functional configuration of the correction chart generator that generates the correction chart is described. FIG. 9 is a schematic block diagram illustrating a functional configuration of the FPGA 360 that functions as the correction chart generator. As illustrated in FIG. 9, the FPGA 360 includes a drive waveform correction unit 402, a pixel count unit 403, a drive waveform correction value calculation unit 404, and an image data output 405.

The image data output 405 stores image data to be discharged in the next cycle. The pixel count unit 403 that receives image data from the image data output 405 outputs a number of driven nozzles in the next cycle. The drive waveform correction calculation unit 404 that receives the number of driven nozzles from the pixel count unit 403 outputs a drive waveform amplification correction value. A relationship between the number of driven nozzles and the drive waveform amplification correction value may be determined according to the user preference, based on the correction chart (see FIGS. 7A and 7B) formed on the recording medium P.

The drive waveform correction unit 402 that receives the correction value from the drive waveform correction calculation unit 404 corrects the amplification of the drive waveform. The drive waveform is generated based on a drive waveform table 401 stored in the ROM 302. The amplification correction is performed by multiplying the drive waveform amplification correction value to the drive waveform read from the drive waveform table 401. In this case, correction is not performed for a flat portion called intermediate potential, and the multiplication is performed for other portions. The drive waveform table 401 may be stored in any desired memory, such as in the RAM in the FPGA 360. In such case, the drive waveform correction unit 402 selects and reads the drive waveform table 401 to correct using the amplification value read from the drive waveform table 401.

The drive waveform table is a table storing a plurality of drive waveforms that differ depending on a value of temperature.

Figure 17:
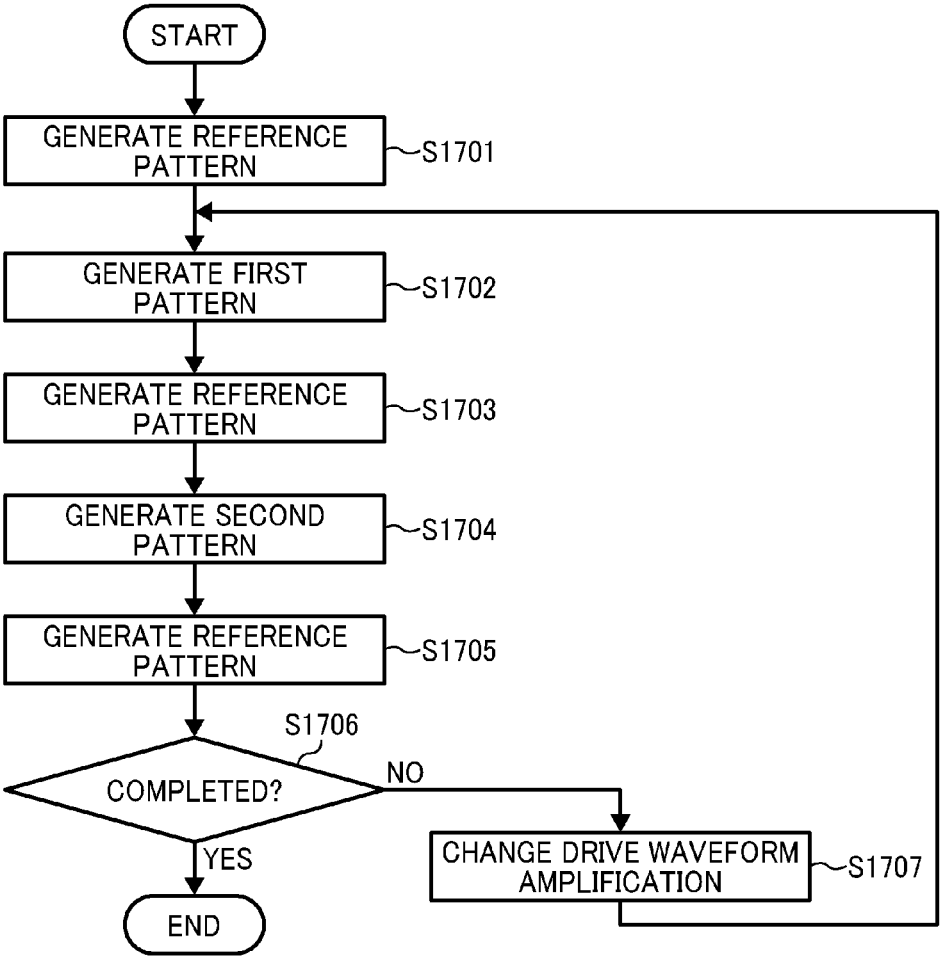
FIG. 17 is a flowchart illustrating operation of generating a correction chart, according to an embodiment of the present invention.

Referring now to FIG. 17, a method of generating a correction chart is described according to an embodiment. In this embodiment, the correction chart 100 is generated using the above-described liquid discharging device.

The main control unit 310 applies a drive waveform of 0% amplification to 192 ch nozzles of the liquid discharging head 6, to form the reference pattern 110 on the recording medium P (S1701). In this embodiment, the drive waveform amplification for generating the reference pattern 110 is fixed at 0%.

Next, the main control unit 310 applies a drive waveform of amplification that is arbitrarily set, to 40 ch nozzles selected from the 192 ch nozzles of the liquid discharge head 6, to form the first correction pattern 111 on the recording medium P (S1702). The drive waveform amplification here is set to the initial value of 0%.

The main control unit 310 applies a drive waveform of 0% amplification to 192 ch nozzles of the liquid discharging head 6, to further form the reference pattern 110 on the recording medium P (S1703).

Next, the main control unit 310 applies a drive waveform of amplification that is arbitrarily set, to 100 ch nozzles selected from the 192 ch nozzles of the liquid discharge head 6, to form the second correction pattern 112 on the recording medium P (S1704). The drive waveform amplification here is set to the initial value of 0%.

The main control unit 310 applies a drive waveform of 0% amplification to 192 ch nozzles of the liquid discharging head 6, to further form the reference pattern 110 on the recording medium P (S1705).

The main control unit 310 determines whether formation of the correction chart 100 is completed (S1706). If it is determined that formation of the correction chart 100 is completed (S1706: YES), the operation ends. If it is determined that formation of the correction chart 100 is not completed (S1706: NO), the operation proceeds to S1707 to change the drive waveform amplification, and returns to S1702 to repeat operation.

Next, the main control unit 310 applies a drive waveform of amplification that is multiplied by the drive waveform amplification of 10% that is changed at S1707, to 40 ch nozzles selected from the 192 ch nozzles of the liquid discharge head 6, to form the first correction pattern 111 on the recording medium P (S1702).

The main control unit 310 applies a drive waveform of 0% amplification to 192 ch nozzles of the liquid discharging head 6, to further form the reference pattern 110 on the recording medium P (S1703).

Next, the main control unit 310 applies a drive waveform of amplification having a value multiplied by the drive waveform amplification of 10% that is changed at S1707, to 100 ch nozzles selected from the 192 ch nozzles of the liquid discharge head 6, to form the second correction pattern 112 on the recording medium P (S1704).

The main control unit 310 applies a drive waveform of 0% amplification to 192 ch nozzles of the liquid discharging head 6, to further form the reference pattern 110 on the recording medium P (S1705).

As described above, in generating the correction chart 100 according to the embodiment, the drive waveform amplification for forming the reference pattern 110 is fixed at 0%, and the drive waveform amplification for generating the first correction pattern 111 and the second correction pattern 112 are changed from 0%, 10%, . . . , etc. Further, the first correction pattern 111 and the second correction pattern 112 are alternatively formed between the adjacent reference patterns 110. This improves visibility in density uneveness.

The above-described operation of generating the correction chart 100 may be used to form various correction charts, as described below referring to modification examples. More specifically, the correction chart 100 may vary depending on formed positions or the arrangement order of the reference pattern 110, the first correction pattern 111, and the second correction pattern 112. The formed positions or the arrangement order of these patterns may be changed under control of the controller 300 (FIG. 3) that controls operation of the liquid discharge head 6. Further, a number of correction patterns may be not limited to two.

Next, a first modification example of the correction chart 100 generated for the above-described liquid discharging device, using the above-described generating method, is described. The correction chart 100 of the first modification example is a correction chart for the liquid discharging device with a serial head or a line head.

In the following, formation of the correction chart 100 is described in relation to scan operation of the liquid discharge head 6 is described. As described above, in the liquid discharging device with the serial head, the liquid discharge head 6 discharges the liquid while performing scan operation, to print such as an image on the recording medium P. In the case of serial head, the range where the liquid discharge head 6 moves in one scan operation corresponds to a range from the leading end to the tailing end of the entire movement range of of the carriage 5 in the main-scanning direction. That is, driving of the liquid discharge head 6 for moving the carriage 5 from the leading end to the tailing end in the movement range corresponds to one scan operation (See FIG. 7A). In the case of line head, a transfer of the recording medium P in the sub-scanning direction corresponds to one scan operation.

Figure 11:
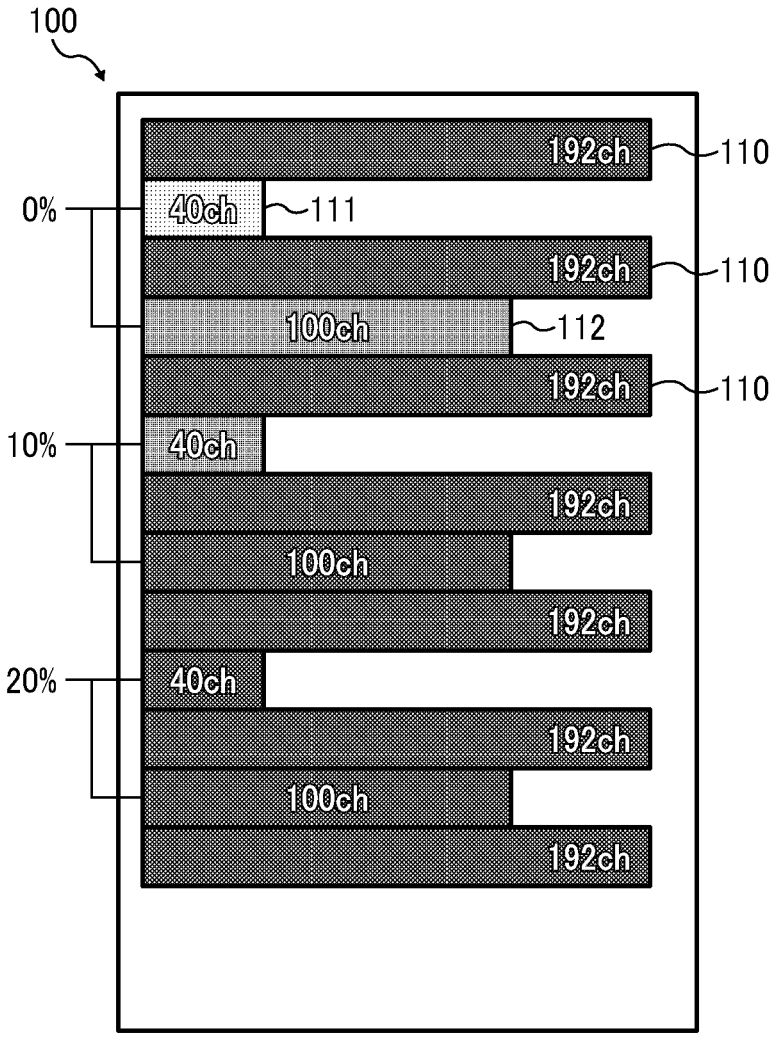
FIG. 11 is a diagram illustrating a first modification example of a correction chart, formed using a line head.

As illustrated in FIG. 11, to form the first modification example of the correction chart 100, the main control unit 310 applies a drive waveform of 0% amplification (fixed value) to 192 ch nozzles of the liquid discharging head 6, to form the reference pattern 110 on the recording medium P by one scan operation of the liquid discharge head 6. Next, the main control unit 310 applies a drive waveform of amplification that is changed, to 40ch nozzles selected from the 192 ch nozzles of the liquid discharge head 6, to form the first correction pattern 111 on the recording medium P. After formation of the reference pattern 110, the drive waveform amplification is changed, for example, from 0%, 10%, 20%, etc. Subsequently, the main control unit 310 applies a drive waveform of amplification that is changed, to 100 ch nozzles selected from the 192 ch nozzles of the liquid discharge head 6, to form the second correction pattern 112 on the recording medium P. The drive waveform amplification is changed, for example, from 0%, 10%, 20%, etc.

As illustrated in FIG. 11, in generating the correction chart 100, firstly, the reference pattern 110, the first correction pattern 111, and the second correction pattern 112 are formed with the drive waveform amplification of 0%. Subsequently, the reference pattern 110 with the drive waveform amplification of 0%, and the first correction pattern 111 and the second correction pattern 112 with the drive waveform amplification of 10% are formed. Subsequently, the reference pattern 110 with the drive waveform amplification of 0%, and the first correction pattern 111 and the second correction pattern 112 with the drive waveform amplification of 20% are formed.

As described above, in generating the correction chart 100 according to the embodiment, the drive waveform amplification for forming the reference pattern 110 is fixed at 0%, and the drive waveform amplification for generating the first correction pattern 111 and the second correction pattern 112 are changed from 0%, 10%, 20% . . . , etc.

When the correction chart 100 is generated by such a method, the user can easily confirm, by visual observation, the amplification at which the density of the reference pattern 110 and the density of the correction pattern 111 or 112 become the same or become closest. Accordingly, the user can appropriately select a favorable amplification. For example, the user can select 10% as the amplification of when the number of driven nozzles is 100 ch, and 20% as the amplification of when the number of driven nozzles is 40 ch. Accordingly, the drive characteristics of the liquid discharge head 6 can be obtained without using a reader for reading the correction chart (such as a scanner), thus, making the device simple as well as reducing the manufacturing cost. The increased accuracy in detection further suppresses the influences by the crosstalk with high accuracy.

Next, a second modification example of the correction chart 100 is described. The correction chart 100 of the second modification example is a correction chart for the liquid discharging device with a serial head.

Figure 12:
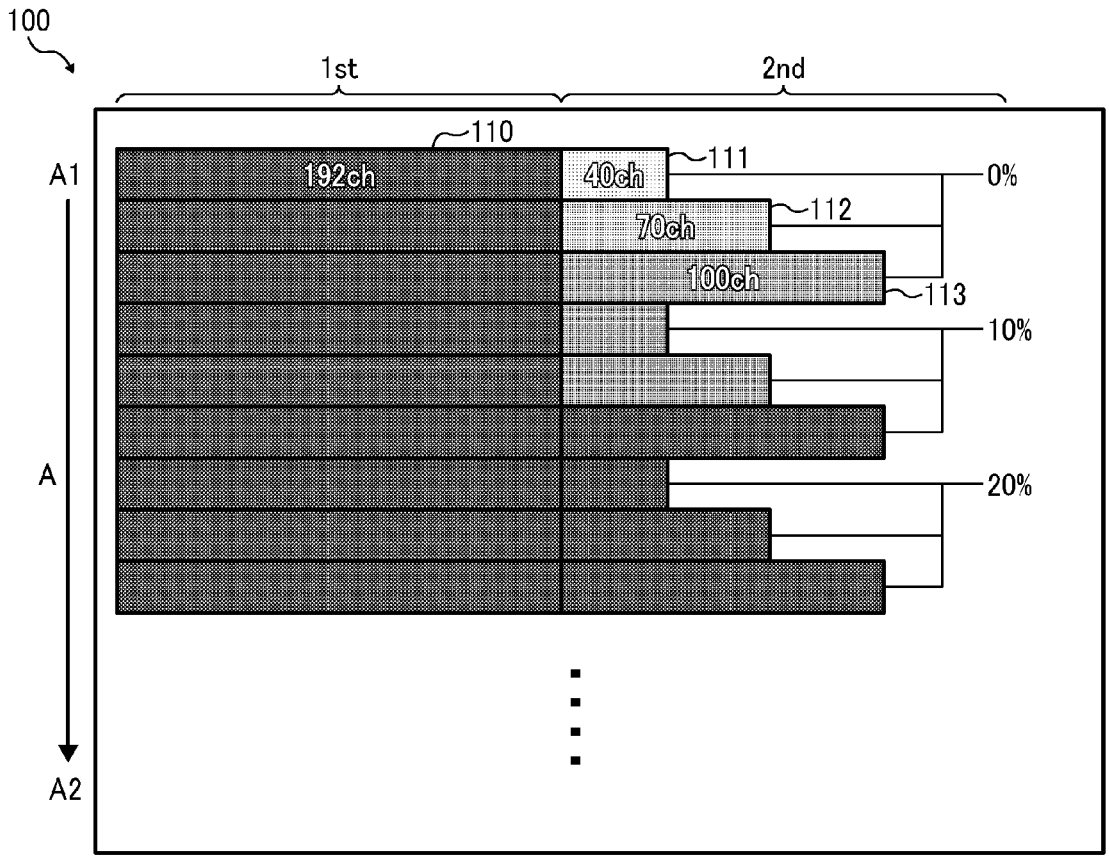
FIG. 12 is a diagram illustrating a second modification example of a correction chart, formed using a line head.

As illustrated in FIG. 12, to form the second modification example of the correction chart 100, the main control unit 310 applies a drive waveform of 0% amplification (fixed value) to 192 ch nozzles of the liquid discharging head 6, to form a reference pattern 110 on the recording medium P from the leading end to the tailing end. After forming the reference pattern 110, the recording medium P is transferred in the sub-scanning direction, to form with a first correction pattern 111, a second correction pattern 112, and a third correction pattern 113, by the second scan operation. The main control unit 310 applies a drive waveform of amplification that is changed, to 40 ch nozzles selected from the 192 ch nozzles of the liquid discharge head 6, to form the first correction pattern 111 on the recording medium P. The drive waveform amplification is changed, for example, from 0%, 10%, 20%, etc. The main control unit 310 applies a drive waveform of amplification that is changed, to 70ch nozzles selected from the 192 ch nozzles of the liquid discharge head 6, to form the second correction pattern 112 on the recording medium P. The drive waveform amplification is changed, for example, from 0%, 10%, 20%, etc. The main control unit 310 applies a drive waveform of amplification that is changed, to 100 ch nozzles selected from the 192 ch nozzles of the liquid discharge head 6, to form the third correction pattern 113 on the recording medium P. The drive waveform amplification is changed, for example, from 0%, 10%, 20%, etc.

In generating the second modification example of the correction chart 100, after the reference pattern 110 is formed by the first scan operation, the recording medium P is transferred by a distance that corresponds to the size of the nozzle array of the 192 ch nozzles in the sub-scanning direction. The plurality of correction patterns are formed on the recording medium P, adjacent to the reference pattern 110, by the subsequent scan operation. The first correction pattern 111, the second correction pattern 112, and the third correction pattern 113 are formed, while changing the drive waveform amplification, for example, from 0%, 10%, 20%, etc.

In the case of the serial head, since the guide rod 12 is fixed, deviation of the carriage 5 becomes the same even if other correction patterns are continuously formed in the same main-scanning direction adjacent to one correction pattern. With the correction chart 100, the density unevenness of an image due to the crosstalk and the density unevenness of an image due to other causes can be reliably isolated. Further, in this example, it is not necessary to sandwich the reference pattern 110 between the correction patterns. Therefore, the correction chart 100 can be made short in the main-scanning direction.

Next, a third modification example of the correction chart 100 is described. The correction chart 100 of the third modification example is a correction chart for the liquid discharging device with a serial head.

Figure 13:
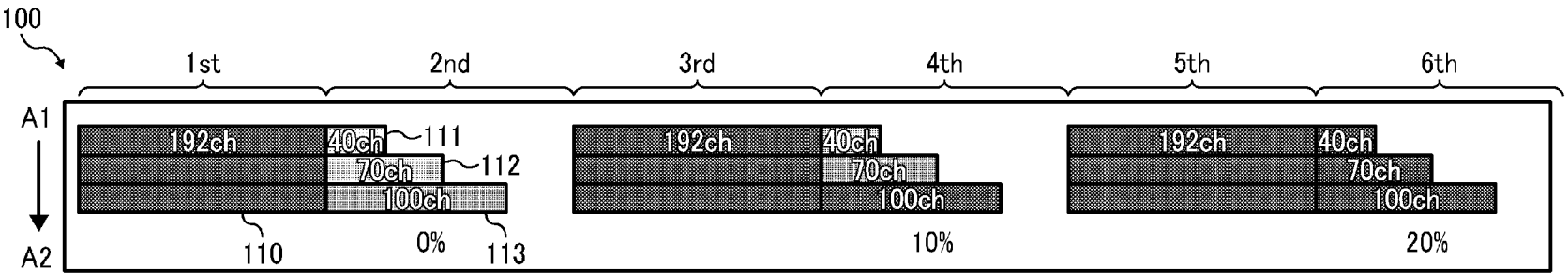
FIG. 13 is a diagram illustrating a third modification example of a correction chart, formed using a line head.

As illustrated in FIG. 13, to form the third modification example of the correction chart 100, the main control unit 310 applies a drive waveform of 0% amplification (fixed value) to 192 ch nozzles of the liquid discharging head 6, to form a reference pattern 110 on the recording medium P from the leading end to the tailing end in the main-scanning direction. After forming the reference pattern 110, the recording medium P is transferred by a distance that corresponds to the size of the nozzle array of the 192 ch nozzles.

After forming the reference pattern 110, a first correction pattern 111, a second correction pattern 112, and a third correction pattern 113 are formed, side by side, in the main-scanning direction by the second scan operation.

The recording medium P is then transferred by a distance that corresponds to the size of the nozzle array of the 192 ch nozzles. Subsequently, the reference pattern 110 is formed by the third scan operation. After forming the reference pattern 110, the recording medium P is transferred by a distance that corresponds to the size of the nozzle array of the 192 ch nozzles.

Subsequently, the first correction pattern 111, the second correction pattern 112, and the third correction pattern 113 are formed, side by side, in the main-scanning direction by the fourth scan operation.

The recording medium P is then transferred by a distance that corresponds to the size of the nozzle array of the 192 ch nozzles. Subsequently, the reference pattern 110 is formed by the fifth scan operation. After forming the reference pattern 110, the recording medium P is transferred by a distance that corresponds to the size of the nozzle array of the 192 ch nozzles. Subsequently, the reference pattern 110 is formed by the sixth scan operation.

In generating the third modification example of the correction chart 100, after the reference pattern 110 is formed by the first scan operation, the recording medium P is transferred by a distance that corresponds to the size of the nozzle array of the 192 ch nozzles in the sub-scanning direction. The plurality of correction patterns 111, 112, and 113 are formed on the recording medium P, side by side, adjacent to the reference pattern 110, by the second scan operation. In a substantially similar manner, while the recording medium P is being conveyed, the reference pattern 110 is formed by the third scan operation, the correction patterns are formed by the fourth scan operation, the reference pattern is formed by the fifth operation, and the correction patterns are formed by the sixth operation. The first correction pattern 111, the second correction pattern 112, and the third correction pattern 113 are formed, while changing the amplification of the drive waveform to be applied to a drive voltage, for example, from 0%, 10%, 20%, etc.

According to the third modification example of the correction chart 100, the correction chart 100 can be made short in the main-scanning direction, and deviation arising from accuracy of the device such as the guide rod 12 or the carriage 5 can be suppressed.

Next, a fourth modification example of the correction chart 100 is described. The correction chart 100 of the fourth modification example is a correction chart for the liquid discharging device with a serial head.

Figure 14:
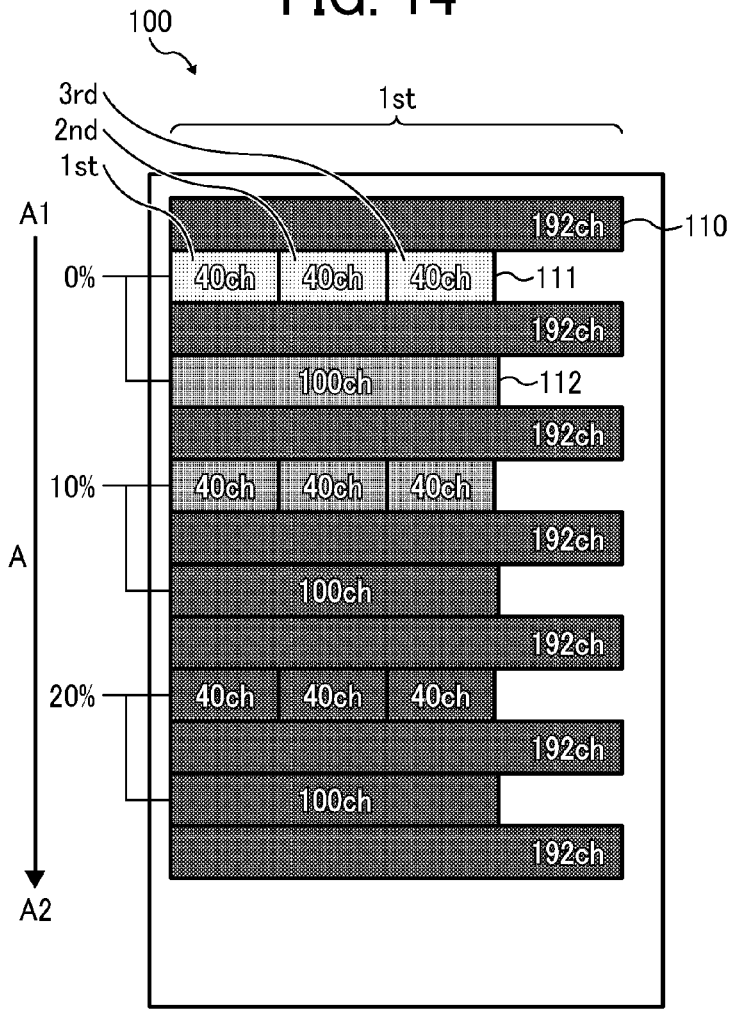
FIG. 14 is a diagram illustrating a fourth modification example of a a correction chart, formed using a line head.

As illustrated in FIG. 14, to form the fourth modification example of the correction chart 100, the main control unit 310 applies a drive waveform of 0% amplification (fixed value) to 192 ch nozzles of the liquid discharging head 6, to form a reference pattern 110 on the recording medium P, by the first scan operation. Still in the first scan operation, the main control unit 310 applies a drive waveform of 0% amplification to 40 ch nozzles of the liquid discharge head 6, to form a first correction pattern 111 adjacent to the reference pattern 110 in the main-scanning direction. After forming the first correction pattern 111 by the first scan operation, the reference pattern 110 is formed. After forming the reference pattern 110 by the first scan operation, the main control unit 310 applies a drive waveform of 0% amplification to 100 ch nozzles of the liquid discharge head 6, to form a second correction pattern 112.

After forming the second correction pattern 112, in the first scan operation, the main control unit 310 forms the reference pattern 110 with the drive waveform of 0% amplification and the first correction pattern 111 with the drive waveform of 10% amplification. Subsequently, the main control unit 310 forms the reference pattern 110 with the drive waveform of 0% amplification and the second correction pattern 112 with the drive waveform of 10% amplification. Subsequently, the reference pattern 110 with the drive waveform of 0% amplification, and the first correction pattern 111 with the drive waveform of 20% amplification are formed. Then, the reference pattern 110 with the drive waveform of 0% amplification, and the second correction pattern 112 with the drive waveform of 20% amplification are formed.

In generating the fourth modification example of the correction chart 100, in the first scan operation, the first correction pattern 111 and the second correction pattern 112 with the drive waveform of 0% amplification, the first correction pattern 111 and the second correction pattern 112 with the drive waveform of 10% amplification, and the first correction pattern 111 and the second correction pattern 112 with the drive waveform of 20% amplification are formed, such that they are sandwiched between the reference patterns 110 in the main-scanning direction.

The recording medium P is transferred by a distance that corresponds to the size of the nozzle array of the 40 ch nozzles. In the second scan operation, the first correction pattern 111 with the drive waveform of 0% amplification is formed adjacent to the first correction pattern 111 that is formed with the drive waveform of 0% amplification in the first scan operation. In the second scan operation, the reference pattern 110 with the drive waveform of 10% amplification is formed adjacent to the first correction pattern 111 with the drive waveform of 10% amplification. Further, in the second scan operation, the first correction pattern 111 with the drive waveform of 20% amplification is formed adjacent to the first correction pattern 111 with the drive waveform of 20% amplification that is formed in the first scan operation.

In generating the fourth modification example of the correction chart 100, the recording medium P is transferred by a distance that corresponds to the size of the nozzle array of the 40 ch nozzles. In the third scan operation, the first correction pattern 111 with the drive waveform of 0% amplification is formed adjacent to the first correction pattern 111 that is formed with the drive waveform of 0% amplification in the second scan operation. In the third scan operation, the first correction pattern 111 with the drive waveform of 10% amplification is formed adjacent to the first correction pattern 111 with the drive waveform of 10% amplification that is formed in the second scan operation. In the second scan operation, the first correction pattern 111 with the drive waveform of 20% amplification is formed adjacent to the first correction pattern 111 with the drive waveform of 20% amplification that is formed in the second scan operation.

In the fourth modification example of the correction chart 100, an area of the first correction pattern 111, which is formed using the 40 ch nozzles selected from the 192 ch nozzles of the liquid discharge head 6, is made larger. Generally, the correction chart that is generated with lower number of driven nozzles, has a narrower printed range, making it difficult to be visually checked. Even using such correction chart, scan operations may be repeated a plurality of times to increase the printed range, thus helping the user to easily check the patterns.

Next, a fifth modification example of the correction chart 100 is described. The correction chart 100 of the fifth modification example is a correction chart for the liquid discharging device with a serial head.

Figure 15:
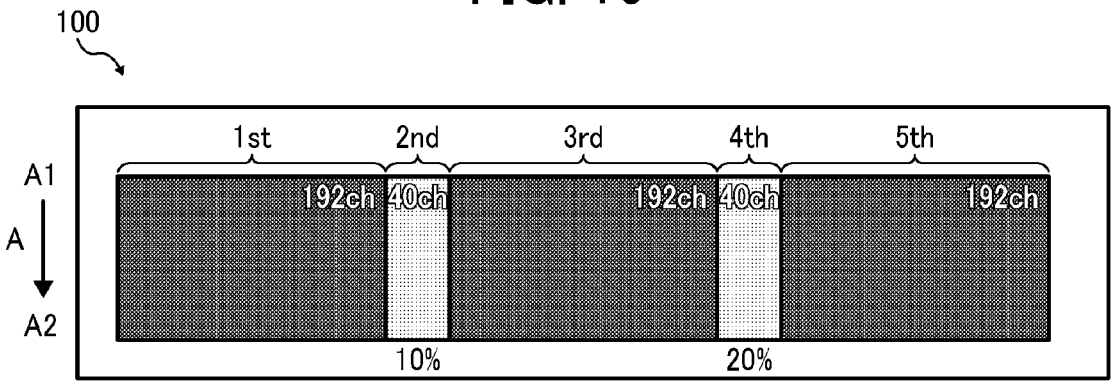
FIG. 15 is a diagram illustrating a fifth modification example of a correction chart, formed using a line head.

As illustrated in FIG. 15, in the first scan operation, the main control unit 310 applies a drive waveform of 0% amplification (fixed value) to 192 ch nozzles of the liquid discharging head 6, to form a reference pattern 110 on the recording medium P from the leading end to the tailing end in the main-scanning direction. The recording medium P is then transferred by a distance that corresponds to the size of the nozzle array of the 192 ch nozzles. In the second scan operation, the first correction pattern 111 with the drive waveform of 10% amplification is formed adjacent to the reference pattern 110 formed in the first scan operation. After conveying the recording medium P by a distance that corresponds to the size of the 192 ch nozzle array, in the third scan operation, the reference pattern 110 with the drive waveform of 0% amplification is formed adjacent to the first correction pattern 111 formed in the second scan operation. After conveying the recording medium P by a distance that corresponds to the size of the 192 ch nozzle array, in the fourth scan operation, the first correction pattern 111 with the drive waveform of 20% amplification is formed adjacent to the reference pattern 110 formed in the third scan operation. After conveying the recording medium P by a distance that corresponds to the size of the 192 ch nozzle array, in the fifth scan operation, the reference pattern 110 with the drive waveform of 0% amplification is formed adjacent to the first correction pattern 111 formed in the fourth scan operation.

In the fifth modification example of the correction chart 100, the first correction pattern 111, which is formed using the 40 ch nozzles selected from the 192 ch nozzles of the liquid discharge head 6, is formed such that it is sandwiched between the reference patterns 110 in the sub-scanning direction. With this correction chart, the first correction pattern 111 having relatively a narrower printed range, can be easily compared with the reference pattern 110, to visually detect differences in density or density uneveness of an image.

In the case of the serial head, since the guide rod 12 is fixed, deviation of the carriage 5 becomes the same even if other correction patterns are continuously formed in the same main-scanning direction adjacent to one correction pattern. With the correction chart 100, the density unevenness of an image due to the crosstalk and the density unevenness of an image due to other causes can be reliably isolated.

Next, a sixth modification example of the correction chart 100 is described. The correction chart 100 of the sixth modification example is a correction chart for the liquid discharging device with a serial head.

Figure 16:
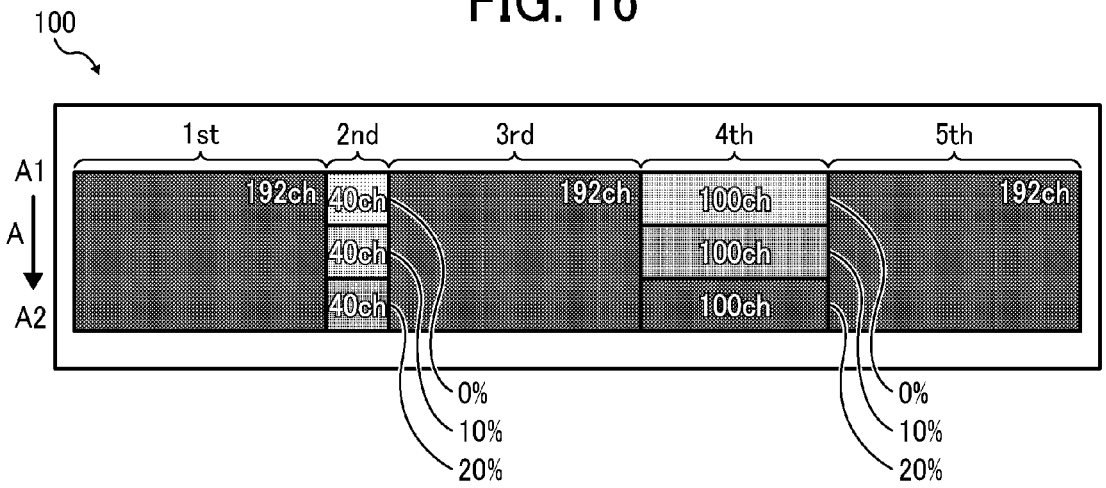
FIG. 16 is a diagram illustrating a sixth modification example of a correction chart, using a line head.

As illustrated in FIG. 16, in the first scan operation, the main control unit 310 applies a drive waveform of 0% amplification (fixed value) to 192 ch nozzles of the liquid discharging head 6, to form a reference pattern 110 on the recording medium P from the leading end to the tailing end in the main-scanning direction.

After conveying the recording medium P by a distance that corresponds to the size of the 192 ch nozzle array, in the second scan operation, the first correction patterns 111 with the drive waveform of amplification of 0%, 10%, and 20% are formed adjacent to the reference pattern 110 formed in the first scan operation. After conveying the recording medium P by a distance that corresponds to the size of the 40 ch nozzle array, in the third scan operation, the reference pattern 110 with the drive waveform of 0% amplification is formed adjacent to the first correction patterns 111 formed in the second scan operation. After conveying the recording medium P by a distance that corresponds to the size of the 192 ch nozzle array, in the fourth scan operation, the second correction patterns 112 with the drive waveform of amplification of 0%, 10%, and 20% are formed adjacent to the reference pattern 110 formed in the third scan operation. After conveying the recording medium P by a distance that corresponds to the size of the 100 ch nozzle array, in the fifth scan operation, the reference pattern 110 with the drive waveform of 0% amplification is formed adjacent to the second correction patterns 112 formed in the fourth scan operation.

In the sixth modification example of the correction chart 100, the first correction pattern 111, which is formed using the 40 ch nozzles selected from the 192 ch nozzles of the liquid discharge head 6, is formed such that it is sandwiched between the reference patterns 110 in the sub-scanning direction. With this correction chart, the first correction pattern 111 having relatively a narrower printed range, can be easily compared with the reference pattern 110, to visually detect differences in density or density uneveness of an image.

In the case of the serial head, since the guide rod 12 is fixed, deviation of the carriage 5 becomes the same even if other correction patterns are continuously formed in the same main-scanning direction adjacent to one correction pattern. With the correction chart 100, the density unevenness of an image due to the crosstalk and the density unevenness of an image due to other causes can be reliably isolated.

In the sixth modification example of the correction chart 100, the first correction pattern 111 and the second correction pattern 112, are alternately formed so as to be sandwiched between the first reference patterns, while changing the drive waveform amplification to 0%, 10%, and 20% in the second and fourth scan operations. Therefore, the correction chart 100 can be made short in the main-scanning direction.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

The invention claimed is:

1. A liquid discharging device comprising:

a liquid discharge head having a plurality of nozzles that are arranged to form a nozzle array; and a controller configured to drive the liquid discharge head to discharge a liquid to form an image on a recording sheet, wherein, when forming a correction chart including a reference pattern and a correction pattern, the controller is further configured to drive a first number of the plurality of nozzles to form the reference pattern on the recording sheet along a direction of the nozzle array, the first number being a number equal to or less than a total number of the plurality of nozzles of the nozzle array, drive a second number of the plurality of nozzles that is different than the first number of nozzles driven in forming the reference pattern, to form the correction pattern on the recording sheet along the direction of the nozzle array, change an amplification of a drive waveform based on a drive waveform correction value and a drive waveform related to the second number of the plurality of nozzles.

2. The liquid discharge device according to claim 1, wherein the correction pattern at least includes a first correction pattern and a second correction pattern, and the controller is further configured to drive a first number of the plurality of nozzles that is different than the first number of nozzles driven in forming the reference pattern, to form the first correction pattern adjacent to the reference pattern, drive a third number of the plurality of nozzles that is different than the second number of nozzles driven in forming the first correction pattern, to form the second correction pattern adjacent to the first correction pattern, and drive the first number of the plurality of nozzles to form another reference pattern adjacent to the second correction pattern.

3. The liquid discharging device according to claim 1, further comprising:

a control panel to receive a user input, wherein the controller is further configured to change a width of the reference pattern and a width of the correction pattern according to the user input.

4. The liquid discharging device according to claim 1, wherein the controller is further configured to form the reference pattern and the correction pattern such that end portions of the reference pattern and the correction pattern are positioned close to a left end or a right end of a print width of the recording sheet.

5. The liquid discharging device according to claim 1, wherein the controller is further configured to change density of the reference pattern according to a user input.

6. The liquid discharging device according to claim 1, wherein the liquid discharge head is a serial head, and the controller is further configured to form the reference pattern in a first scan, and form the correction pattern in a second scan.

7. The liquid discharging device according to claim 1, wherein the liquid discharge head is a serial head, and the controller is further configured to form the reference pattern in an odd-numbered scan, and form the correction pattern in an even numbered scan with the drive waveform having an amplification being changed.

8. A method of generating a correction chart including a reference pattern and a correction pattern, using a liquid discharged from a liquid discharge head, the liquid discharge head having a plurality of nozzles that are arranged to form a nozzle array, the method comprising:

driving a first number of the plurality of nozzles to form the reference pattern on the recording sheet along a direction of the nozzle array, the first number being a number equal to or less than a total number of the plurality of nozzles of the nozzle array; and driving a second number of the plurality of nozzles that is different than the predetermined number of nozzles driven in forming the reference pattern, to form the correction pattern on the recording sheet along the direction of the nozzle array, and changing an amplification of a drive waveform based on a drive waveform correction value and a drive waveform related to the second number of the plurality of nozzles.

9. The method of claim 8, wherein the driving to form the correction pattern includes:

driving a third number of the plurality of nozzles that is different than the first number of nozzles driven in forming the reference pattern, to form a first correction pattern adjacent to the reference pattern; and driving a fourth number of the plurality of nozzles that is different than the third number of nozzles driven in forming the first correction pattern, to form a second correction pattern adjacent to the first correction pattern, the method further comprising:

driving the first number of the plurality of nozzles to form another reference pattern adjacent to the second correction pattern.

10. A non-transitory recording medium storing a plurality of instructions which, when executed by a processor, cause the processor to perform a method of generating a correction chart including a reference pattern and a correction pattern, using a liquid discharged from a liquid discharge head, the liquid discharge head having a plurality of nozzles that are arranged to form a nozzle array, the method comprising:

driving a first number of the plurality of nozzles to form the reference pattern on the recording sheet along a direction of the nozzle array, the first number being a number equal to or less than a total number of the plurality of nozzles of the nozzle array; and driving a second number of the plurality of nozzles that is different than the first number of nozzles driven in forming the reference pattern, to form the correction pattern on the recording sheet along the direction of the nozzle array, and changing an amplification of a drive waveform based on a drive waveform correction value and a drive waveform related to the second number of the plurality of nozzles.

* * * * *